US008505885B2

(12) United States Patent
Hildebrand et al.

(10) Patent No.: US 8,505,885 B2
(45) Date of Patent: Aug. 13, 2013

(54) AERATION DIFFUSER

(76) Inventors: Martin Hildebrand, Winnipeg (CA); Merle Kroeker, Winnipeg (CA); Byron Heppner, Winnipeg (CA)

( * ) Notice: Subject to any disclaimer, the term of this patent is extended or adjusted under 35 U.S.C. 154(b) by 433 days.

(21) Appl. No.: 12/950,093

(22) Filed: Nov. 19, 2010

(65) Prior Publication Data

US 2011/0285037 A1 Nov. 24, 2011

Related U.S. Application Data

(60) Provisional application No. 61/262,744, filed on Nov. 19, 2009.

(51) Int. Cl.
*B01F 3/04* (2006.01)

(52) U.S. Cl.
USPC ..... 261/122.1; 261/124

(58) Field of Classification Search
USPC ..... 261/122.1, 122.2, 124, DIG. 70
See application file for complete search history.

(56) References Cited

U.S. PATENT DOCUMENTS 3,206,178 A * 9/1965 Lamb ..... 239/145
4,118,447 A * 10/1978 Richter ..... 261/122.1
4,622,139 A * 11/1986 Brown ..... 210/170.06
5,133,876 A * 7/1992 Tharp ..... 210/758
5,587,114 A * 12/1996 Tharp ..... 261/124
6,264,176 B1 7/2001 Dickman et al.
7,014,176 B2 * 3/2006 Sebastiani et al. ..... 261/122.1
7,526,848 B2 * 5/2009 Lindbo ..... 29/426.5
7,622,040 B2 * 11/2009 Mitchell et al. ..... 210/242.2
8,241,497 B2 * 8/2012 Buch et al. ..... 210/605
2007/0257382 A1 * 11/2007 Mitchell ..... 261/100
2009/0095692 A1 * 4/2009 Tharp ..... 210/752

* cited by examiner

*Primary Examiner* — Charles Bushey
(74) *Attorney, Agent, or Firm* — Kyle R. Satterthwaite; Ryan W. Dupuis; Ade & Company, Inc

(57) ABSTRACT

A diffuser for oxygenation of aqueous media comprises a manifold connectable to a source of pressurized oxygen-containing gas and having a plurality of outlet ports communicating a hollow interior of the manifold with an exterior thereof. A plurality of flexible microporous tubular membranes each have a coupled end secured to the manifold at a respective one of the outlet ports thereof to communicate an internal passage of the tubular membrane with the hollow interior of the manifold. An elongated rod extends along each tubular membrane within the internal passage thereof to maintain a length of the tubular membrane in an orientation projecting outward from the manifold with the free end of the tubular membrane further outward from the manifold than any other portion of the tubular membrane. The rods prevent curling of the tubular membranes over time when the diffuser is submerged in a liquid medium for use.

20 Claims, 2 Drawing Sheets

VII
VII
VIII
VIII
VI
VI
24
26
28
28a
24a
40
50
38
14
14a
14b
36
34
34a
30
32

AERATION DIFFUSER

CROSS REFERENCE TO RELATED APPLICATIONS

This application claims benefit under 35 U.S.C. 119(e) of U.S. Provisional Patent Application Ser. No. 61/262,744, filed Nov. 19, 2009.

FIELD OF THE INVENTION

The invention relates generally to aeration diffusers for treating aqueous media with fine bubbles of air or other gas, and more particularly to a new and improved diffuser featuring multiple microporous tubular membranes coupled to a manifold in positions projecting therefrom with rigid or semi-rigid rods maintaining these membranes in such positions.

BACKGROUND OF THE INVENTION

U.S. Pat. No. 6,264,176, herein incorporated by reference, teaches a diffuser for mixing and oxygenating water or other liquid and featuring a flexible self supporting microporous tubular membrane arranged in a spiral configuration about a frame and manifold assembly that supports the membrane and feeds air or gas thereto from a pressurized source. In implementation of many prior art diffusers of this type over several years, various shortcomings have been noted, and include:

- breakage susceptibility of PVC frame components in cold temperatures;
- breakage susceptibility of PVC manifold components in cold temperatures;
- susceptibility of plastics and other inorganic stringy or fiberous materials present in the water being treated to wrapping around the porous membrane, the spiral design of the diffusers making removal of plastics or fiberous materials very difficult;
- dual point feeding of seventeen feet of membrane at high airflows results in excessive back-pressure in the diffusers, leading to increased air supply motor power requirements;
- the unsupported spiral membrane configuration has led to membrane failure (after several years of use) in some applications; and
- although initial test numbers were those presented in the "Summary of the Invention" section of the patent, oxygen transfer testing verification showed results being significantly lower than efficiency ranges determined by initial oxygen transfer testing.

Accordingly, there is room for improvement in the field of aeration diffusers employing lengths of microporous tubular membrane.

SUMMARY OF THE INVENTION

According to a first aspect of the invention there is provided a diffuser for oxygenation of aqueous media, the diffuser comprising:

a manifold connectable to a source of pressurized oxygen-containing gas to receive the pressurized oxygen-containing gas within a hollow interior of the manifold, the manifold having a plurality of outlet ports communicating the hollow interior of the manifold with an exterior thereof;

a plurality of flexible microporous tubular membranes each having a coupled end secured to the manifold at a respective one of the outlet ports thereof to communicate an internal passage of the tubular membrane with the hollow interior of the manifold and a free end opposite the coupled end; and an elongated rod extending along each tubular membrane within the internal passage thereof to maintain a length of the tubular membrane in an orientation projecting outward from the manifold with the free end of the tubular membrane further outward from the manifold than any other portion of the tubular membrane between the coupled end and free end thereof.

Preferably the plurality of tubular membranes extend along a common direction.

Preferably the plurality of tubular membranes comprises tubular membranes projecting from opposite sides of the manifold.

Preferably the plurality of tubular membranes comprises multiple tubular membranes projecting from each of the opposite sides of the manifold.

Preferably the tubular membranes extend more horizontally than vertically away from the manifold.

Preferably the internal passage of each tubular membrane is plugged at a position outward from the manifold along the length of the tubular membrane.

Preferably the internal passage of each tubular membrane is plugged at the free end thereof.

Preferably each rod is solid and of lesser diameter than the internal passage of the tubular membrane in which the rod extends.

Each rod may rest freely within the internal passage of tubular membrane in which the rod extends.

Preferably the manifold comprises an internally threaded passage at each outlet port, each tubular membrane extending into the internally threaded passage at the respective outlet port and being engaged at an outer periphery of the tubular membrane by threads of the threaded passage to secure the coupled end of the tubular membrane to the manifold.

Preferably the hollow interior of the manifold comprises two branches projecting to opposite sides of an inlet axis of an inlet port of the manifold arranged to connect with a gas source supply line, the outlet ports being spaced along the two branches of the hollow interior of the manifold.

Preferably axes of the two branches are coplanar and lie in a plane normal to the inlet axis.

Preferably the axes of the two branches are parallel.

Preferably the axes of the two branches are coincident.

Preferably axes of the outlet ports are coplanar and lie in an outlet plane parallel to the plane in which the axes of the two branches lie.

Preferably the axes of the two branches are coplanar with the axes of the outlet ports.

Preferably the axes of the outlet ports are parallel.

Preferably the axes of the outlet ports are perpendicular to the axes of the two branches.

Preferably an equal number of outlet ports communicate with each of the two branches of the hollow interior of the manifold.

Preferably there is provided a weight coupled to the manifold and positioned on a side thereof opposite the inlet port thereof.

Preferably the tubular membranes are between six and thirty-six inches long.

Preferably the plurality of tubular membranes comprises at least four tubular members, and for example, one embodiment may eight tubular members.

In another embodiment, the plurality of tubular membranes comprises sixteen tubular members.

BRIEF DESCRIPTION OF THE DRAWINGS

In the accompanying drawings, which illustrate exemplary embodiments of the present invention.

DETAILED DESCRIPTION

Figure 1:
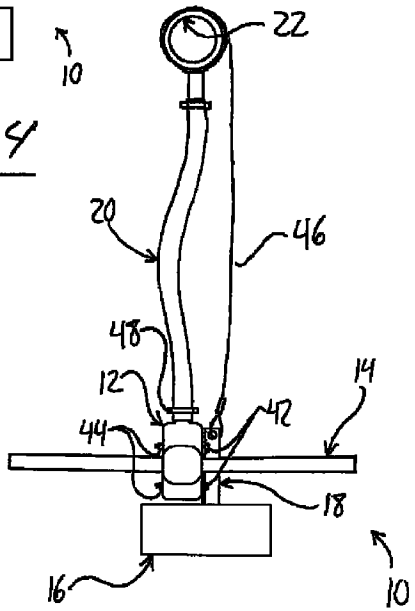
FIG. 1 is a side elevational view of a diffuser of the present invention assembled with an air hose to connect to an air feed pipe supported above the diffuser.
Figure 2:
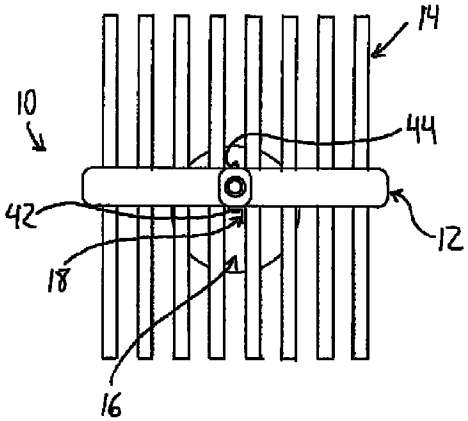
FIG. 2 is an overhead plan view of the diffuser of FIG. 1
Figure 3:
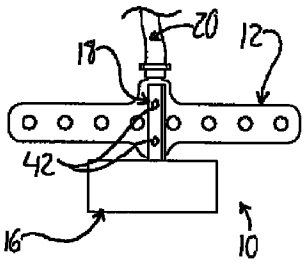
FIG. 3 is front elevational view of the diffuser and air hose assembly of FIG. 1.
Figure 4:
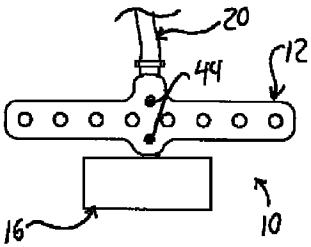
FIG. 4 is rear elevational view of the diffuser and air hose assembly of FIG. 1.

FIG. 1 shows a diffuser 10 featuring a manifold 12, a plurality of flexible tubular microporous membranes 14 projecting horizontally outward from the manifold to opposite sides thereof, and a weight 16 disposed below the manifold and coupled thereto by a bracket 18. The manifold 12 has a supply hose 20 coupled thereto to extend upward from the manifold 12 to an air feed pipe 22 supported at an elevation above the manifold so that a pressurized air or other oxygen-containing gas supply forced through the feed pipe 22 by a pump, blower or compressor will feed the manifold and thus operate the diffuser 10. With a relatively high number of tubular membranes (sixteen in the illustrated embodiment) having relatively short individual lengths but each being fed by a respective dedicated feed point or outlet port of the manifold, friction loss in the membrane is kept low relative to the aforementioned prior art spiral diffuser where a single lengthy tubular membrane is fed only by two air feed points. As a result, a diffuser of the illustrated embodiment of the present invention produced with a comparable total length of membrane results in lower operating pressures and reduced air pump or blower motor energy consumption. With the tubular membranes arranged in two sets of parallel membranes projecting to opposite sides of the manifold, tangling of stringy materials among the membranes is reduced compared to the prior art spiral configuration diffusers, and material that does collect around the membranes on each side of the manifold can be easily removed by a "raking" action pulling the material off the parallel membranes past the free ends thereof by way of the gaps between the adjacent membranes in each of the two sets. Other advantages of the illustrated embodiment of the present invention are presented below as the structure of the diffuser is described in further detail.

The tubular membrane material may be of the same type disclosed in U.S. Pat. No. 6,264,176, which is described as having a maximum internal diameter of about 1 inch and a maximum outer diameter of about 1½ inches, and a pore size in the range of 50-500 microns, preferably at the low end of such range. The prior art patent describes the membrane diameters as preferably being about ⅜" ID and about ½" OD, and the optimum pore size as being about 50 to 100 microns. For the present invention, one preferred embodiment has an inner diameter ½" and an outer diameter of 1". Pores smaller than about 50μ may produce the fine bubbles desired under this invention, but may be less suitable because of the greater air pressure required and resulting higher operating cost. One preferred membrane is that which is made according to the method disclosed in U.S. Pat. No. 4,958,770.

Figures 5, 6, 7, 8:
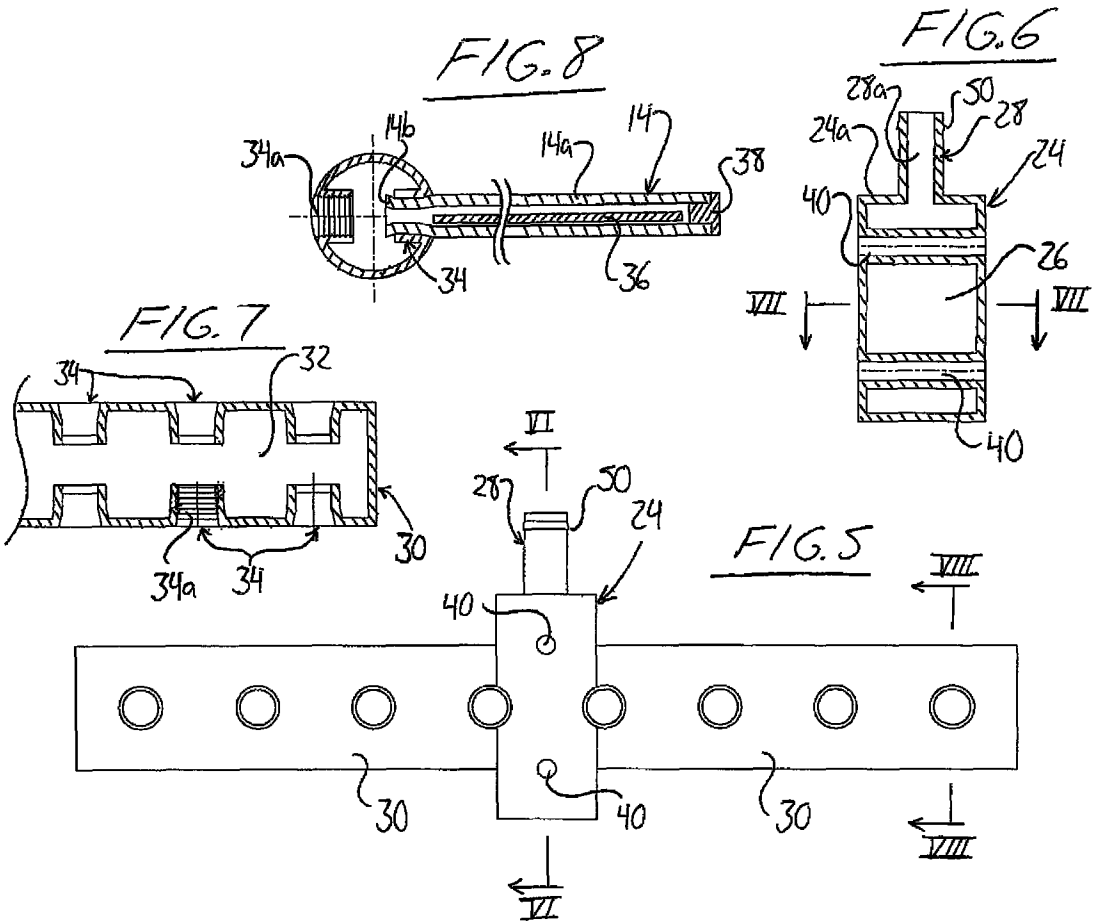
FIG. 5 is a front elevational view of a manifold of a diffuser like that of FIGS. 1 to 4.
FIG. 6 is a cross-section view of the manifold of FIG. 5 as taken along line VI-VI thereof.
FIG. 7 is a cross sectional view of the manifold of FIG. 6 as taken along line VII-VII thereof.
FIG. 8 is a cross sectional view of the manifold of FIG. 5 as taken along line VIII-VIII thereof and illustrating installation of a length of microporous tubular membrane thereon in assembly of a diffuser like that of FIGS. 1 to 4.

FIGS. 5 to 8 illustrate a manifold for a diffuser like that of FIGS. 1 to 4 in greater detail. The manifold 12 features a central body 24 having front, back, left, right top and bottom walls disposed on the six sides of a rectangular volume containing a hollow interior chamber 26 of the central body 24. Referring to FIG. 6, a hollow cylindrical neck 28 projects vertically upward from the top wall 24*a* of the central body through a central opening therein, communicating the interior cylindrical passage 28*a* of the neck 28 with the interior chamber 26 of the central body 24. Referring to FIG. 5, a pair of parallel coaxial hollow branches 30 project laterally from the central body 24 in opposing directions therefrom along a horizontal plane normal to the axis of the vertical neck 28. The hollow interior 32 of each branch 30 communicates with the interior chamber 26 of the central body 24 at the respective side wall of the central body. Each of the branches and the neck of the manifold are sealed to the central body around the opening in the respective wall thereof. The resulting manifold is closed around all sides of its hollow interior with the exception of the inlet port provided at the neck 28 and a series of outlet ports 34 spaced along front and rear sides of the two branches.

The front and rear side of each branch each features one-quarter of a total number of outlet ports 34 of the manifold, each outlet port corresponding to a respective one of the microporous tubular membranes 14. Each outlet port 34 has its axis oriented perpendicular to the axis of the respective branch in the same horizontal plane thereas. Although only one of the outlet ports 34 of FIG. 7 is illustrated as such, each port is internally threaded to form a female attachment element into which the respective microporous membranes can have one of its ends inserted to secure the membrane to the manifold. The port has a length as a result of being defined by a tubular projection extending only inwardly from the wall of the manifold branch by a short distance not reaching the central vertical plane of the branch. This tubular port body allows a relatively thin-walled manifold construction while still providing a significant number of thread turns to securely grip the membrane. The connection of the membrane can best be understood from FIG. 8, where it can be seen that the normal outer diameter of the membrane wall 14*a* exceeds the inner and outer diameters of the internal thread 34*a* of the outlet port 34. The end 14*b* of the membrane to be coupled to the manifold 12 is inserted into the outlet port 34 of the manifold and passed through the port body to reach just past the inner end thereof within the manifold interior, for example by forcing the end initially into the outer threads of the port and then turning or screwing the membrane to urge it further through the threaded port. With the membrane inserted, its resiliency biases the wall of the membrane outward around its hollow interior back toward its larger normal diameter. As this normal outer diameter of the membrane exceeds the diameter of the port, the outer surface of the membrane wall forces itself into the grooves between the ridges of the port body thread, which frictionally engages the membrane to the manifold.

It has been found that when generally linear lengths of the tubular membrane material used in the present invention are submerged in a liquid medium for extended periods of time, the free end of the tubular membrane tends to curl upward and back toward its supported end. As shown in FIG. 8, in order to prevent such curling of the tubular membranes over time when the diffuser is submerged in a liquid medium for use, a rigid or semi-rigid rod 36 is disposed within the internal passage of each tubular membrane to extend along a substantial portion of the length thereof from proximate the coupled end 14*b* of the membrane to proximate the opposing free end 14*c* distal to the manifold 12. The rod resists curling of the tubular membrane in order to retain the tubular membrane in a substantially linear configuration projecting substantially horizontally from the manifold 12 to situate the membrane's free end in a position horizontally furthest from the manifold relative to the rest of the membrane. The outer diameter of the rod 36 is less than the inner diameter of the tubular membrane 14 so that oxygen-containing air or gas fed into the manifold 12 through the neck 28 thereof is free to pass into each membrane through the respective outlet port 34 of the manifold and flow along the membrane between the outer surface(s) of the rod and the inner surfaces of the membrane wall and thus be dispersed into the liquid medium in which the diffuser is deployed through the pores of the membrane wall over the length of the membrane. To ensure that the gas exits the membrane through its porous wall, each membrane is fitted with a plug 38 at its distal end 14*c* to close off the internal passage of the membrane at a distance outward from the manifold to force the gas to exit the membrane at locations between the connection to the manifold and the plugging of the membrane. It will be appreciated that the rod need not be circular in cross-section, completely linear along its elongated dimension or even solid, as even an elongated but non-linear hollow structure of rectangular or other non-circular cross section with sufficient rigidity and small enough cross-section to fit loosely within the membrane could similarly provide the curl-resisting function while still allowing air/gas flow through the membrane without stretching the porous membrane wall. Although the rod is illustrated as resting freely within tubular membrane, it may be possible to somehow attach the rod to the manifold in other embodiments As most visible in FIGS. 5 and 6, the manifold may feature enclosed tubular passages 40 extending through the central body 24 from front to rear in directions parallel to the outlet port axes at vertically spaced positions below the manifold neck 28 for passage of fasteners through them to secure the manifold to the weight of FIGS. 1 to 4. The weight 16 of FIGS. 1 to 4 features a circular annular wall closing around and containing a short vertically-oriented cylindrical body of concrete, the bracket 18 having been cast into the concrete during production of the weight so as to be permanently fixed to the weight 16 in a position vertically upstanding therefrom. As shown, the bracket 18 may be formed from a length of angle bar having a pair of fastener holes vertically spaced apart on one leg of the angle-bar by a center-to-center distance equal to the vertical spacing of the pair of tubular fastener passages 40 on the manifold 12. With the hole-equipped leg of the angle-bar bracket placed against the front or rear face of the manifold to align the bracket's fastener holes and the manifold's passages during assembly of the diffuser, two bolts 42 can be passed through these aligned features and fitted with nuts 44 to clamp the bracket to the manifold and thereby secure the manifold to the weight. The interior chamber 26 of the manifold's central body 24 is sufficiently wide so that air/gas flow into the manifold through the neck 28 can pass around the cylindrical walls of the tubular fastener passages 40, or at least downwardly around the top one of the two illustrated passages above and below the central horizontal plane of the branches 30. As shown in FIG. 1, a hole may be provided through the angle-bar leg not directly fastened to the manifold near the top end of the bracket 18 to tying of a marine grade cable 46 thereto, the cable wrapping around or otherwise being coupled to the air feed pipe 22 when the diffuser is deployed in a liquid medium therebelow for use so that the cable can later be used to retrieve the diffuser from the floor or bed at the bottom of the body of liquid medium. In a conventional manner, the weight acts to maintain the diffuser's position during its use, for example in a seated position on the floor or bed or in a suspended position thereabove below the air feed pipe 22.

For use of the diffuser, the manifold is coupled to a source of pressurized air, for example coupled to the illustrated conventional arrangement of an air feed pipe 22 fed by a pump or blower (not shown), by a non-porous supply hose or tube 20 fitted and secured on the neck 28 of the manifold, for example through use of a hose clamp 48 and an external barb 50 on the neck 28 of the manifold. With the bracket 18 coupled to the air feed pipe 22 by a length of marine grade cable, the diffuser, including the weight, manifold, bracket and membranes, is lowered into the body of water or other liquid medium over which the air feed tube passes to seat the weight on the floor or bed of the body of liquid, or suspend it thereabove. The air/gas pump or blower is operated to force the air/gas through the feed pipes 22 to a plurality of diffusers installed in this manner. The air/gas flows down to the diffusers through their respective air/gas delivery hoses 20, where the feed of air/gas is divided into the multiple tubular membranes of the diffuser where the air/gas escapes through the pores of the membranes to bubble into the body of liquid to be treated by this release of air/gas to oxygenate and mix the liquid.

The multiport manifold may be molded High Density Polyethylene (HDPE), and although the illustrated 16-port embodiment may reflect a typical diffuser being considered for distribution by the applicant, various other numbers of multiple outlet ports may alternatively be used and different models having different port quantities may be produced. The cold temperature strength characteristics of the material and the shape of the manifold reduce the breakage susceptibility over the aforementioned prior art diffusers used by the applicant. The branches of the manifold may be generally rectangular in cross-section, for example like the rectangular configuration with rounded corners and edges shown in FIGS. 1 to 4, or may have other shapes, for example like the circular branch cross-section shown in FIG. 8. Manifold designs intended for production using roto-molding techniques have been produced with rounded-corner rectangular configurations to provide a minimum internal volume required for liquid flow during the molding process and reduce buoyancy of the manifold by keeping the internal volume low to minimize the external weight attached the manifold to anchor the diffuser to the floor or bed of the body of liquid or keep it suspended at a desired position thereabove. Keeping this weight low allows easier retrieval of the diffuser from the bottom of the liquid body at a later date. The bracket connecting the weight and manifold is preferably made of stainless steel or fiberglass, but may alternatively be formed of other materials, and may be of a different shape than the illustrated angle-bar, for example formed by a length of flat bar.

As outlined above, a length of porous membrane is inserted into the manifold at each port such that the number of porous membranes inserted equals the number of ports in the manifold. Where ports are formed by drilling into a molded or otherwise pre-formed unit, one may select how many ports to be formed in a particular manifold unit, and then accordingly attach a corresponding number of membranes. This allows manufacturing of manifolds having different numbers of ports without needing separate molds for the different manifolds. For example, with reference to the sixteen port illustrated embodiments, a single mold can produce units each having sixteen possible ports sites, and each unit can customized by drilling out a desired number of ports up to a maximum of sixteen. This allows production of different units from a single mold, for example including four, eight, twelve and sixteen port versions of the manifold.

The end of the porous membrane opposite the inserted end is plugged to ensure that all gases pass through the porous membrane. Having a significantly greater number of multiple gas feed points in the manifold compared to the prior art, for example the sixteen ports of the illustrated embodiment against the two gas feeds at opposing ends of the prior art spiral membrane, and feeding shorter lengths of membrane at each feed point, for example feeding a one-foot tubular membrane from a single end thereof compared to feeding a single seventeen foot length of membrane from opposing ends thereof in the prior art spiral diffuser, reduces the friction loss in the membrane and results in lower operating pressures and reduced blower motor energy consumption.

Having the membranes protrude horizontally and perpendicular to the manifold allows for easier removal of plastics and fiberous material (resident in the wastewater) by simply "raking" fiberous material off of the ends of the membranes. Testing has shown that the improved design accumulates approximately 25% less fiberous material than the original spiral design.

Each length of membrane protruding from the manifold is internally supported by a semi-rigid rod. The membrane when supported from one end only has shown to have a tendency to "curl" when in wet conditions for an extended period of time. The curling is a result of "memory" from the membrane manufacturing process, in combination with membrane buoyancy that causes its outer end float upward, and is exacerbated when the membrane absorbs moisture. This curling effect reduces the uniformity of the bubbles produces. An oxygen transfer efficiency decrease of 30% has been noted when significant membrane curling is evident.

Parallel oxygen transfer testing of diffusers of the present invention against the prior art spiral diffusers have shown that the new design to be approximately 8% more efficient.

The terms vertical and horizontal are used herein above with reference to the illustrated orientation of the diffuser where the flat bottom face of the cylindrical weight rests atop a flat horizontal surface, the bracket projects vertically upward from the weight and the inlet axis and outlet port axes of the manifold are accordingly oriented vertically and horizontally respectively. Accordingly, the structural description is made in terms of an intended use position in which the diffuser is seated atop a horizontal surface, but it will be appreciated that in actual practical use that the diffuser will not necessarily be disposed atop a perfectly flat horizontal surface, and that in such situations the structural elements of the diffuser or planes or axes used to describe such elements will not lie perfectly vertical or horizontal.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A diffuser for oxygenation of aqueous media, the diffuser comprising:

a manifold connectable to a source of pressurized oxygen-containing gas to receive the pressurized oxygen-containing gas within a hollow interior of the manifold, the manifold having a plurality of outlet ports communicating the hollow interior of the manifold with an exterior thereof; and a plurality of flexible micropourous tubular membranes each having a coupled end secured to the manifold at a respective one of the outlet ports thereof to communicate an internal passage of the tubular membrane with the hollow interior of the manifold and a free end opposite the coupled end;

wherein the manifold comprises an internally threaded passage at each outlet port, each tubular membrane extending into the internally threaded passage at the respective outlet port and being engaged at an outer periphery of the tubular membrane by threads of the threaded passage to secure the coupled end of the tubular membrane to the manifold.

2. The diffuser according to claim 1 wherein the plurality of tubular membranes comprises tubular membranes projecting from opposite sides of the manifold.

3. The diffuser according to claim 2 wherein the plurality of tubular membranes comprises multiple tubular membranes projecting from each of the opposite sides of the manifold.

4. The diffuser according to claim 1 wherein the tubular membranes extend more horizontally than vertically away from the manifold.

5. The diffuser according to claim 1 wherein the internal passage of each tubular membrane is plugged at a position outward from the manifold along the length of the tubular membrane.

6. The diffuser according to claim 5 wherein the internal passage of each tubular membrane is plugged at the free end thereof.

7. The diffuser according to claim 1 further comprising an elongated rod extending along each tubular membrane within the internal passage thereof to maintain a length of the tubular membrane in an orientation projecting outward from the manifold with the free end of the tubular membrane further outward from the manifold than any other portion of the tubular membrane between the coupled end and free end thereof.

8. The diffuser according to claim 7 wherein each rod is solid and of lesser diameter than the internal passage of the tubular membrane in which the rod extends.

9. The diffuser according to claim 7 wherein each rod rests freely within the internal passage of tubular membrane in which the rod extends.

10. The diffuser according to claim 1 wherein the hollow interior of the manifold comprises two branches projecting along axes to opposite sides of an inlet axis of an inlet port of the manifold arranged to connect with a gas source supply line, the outlet ports being spaced along the two branches of the hollow interior of the manifold.

11. The diffuser according to claim 10 wherein the axes of the two branches are coplanar and lie in a plane normal to the inlet axis.

12. The diffuser according to claim 10 wherein the axes of the two branches are parallel.

13. The diffuser according to claim 10 wherein the axes of the two branches are coincident.

14. The diffuser according to claim 10 wherein an equal number of outlet ports communicate with each of the two branches of the hollow interior of the manifold.

15. The diffuser according to claim 11 wherein axes of the outlet ports are coplanar and lie in an outlet plane parallel to the plane in which the axes of the two branches lie.

16. The diffuser according to claim 15 wherein the axes of the two branches are coplanar with the axes of the outlet ports.

17. The diffuser according to claim 15 wherein the axes of the outlet ports are parallel.

18. The diffuser according to claim 15 wherein the axes of the outlet ports are perpendicular to the axes of the two branches.

19. The diffuser according to claim 1 wherein the internally threaded passage at each outlet port is defined by a tubular projection that extends from a chamber wall of the manifold.

20. The diffuser according to claim 19 wherein the tubular projection extends inwardly from the chamber wall of the manifold.

* * * * *